US010258204B2

(12) United States Patent
Gerhold

(10) Patent No.: US 10,258,204 B2
(45) Date of Patent: Apr. 16, 2019

(54) PAPER PRODUCT CENTER SPONGE TUBE AND METHOD

(71) Applicant: Russell J. Gerhold, Pittsburg, PA (US)

(72) Inventor: Russell T. Gerhold, Pittsburgh, PA (US)

( * ) Notice: Subject to any disclaimer, the term of this patent is extended or adjusted under 35 U.S.C. 154(b) by 294 days.

(21) Appl. No.: 15/393,230

(22) Filed: Dec. 28, 2016

(65) Prior Publication Data

US 2017/0181586 A1 Jun. 29, 2017

Related U.S. Application Data

(60) Provisional application No. 62/271,596, filed on Dec. 28, 2015.

(51) Int. Cl.

| | |
|---|---|
| ***A47K 10/16*** | (2006.01) |
| ***A47K 10/38*** | (2006.01) |
| ***B65H 75/04*** | (2006.01) |
| ***B65H 75/10*** | (2006.01) |

(52) U.S. Cl.

CPC ..... *A47K 10/16* (2013.01); *B65H 75/04* (2013.01); *B65H 75/10* (2013.01); *A47K 2010/389* (2013.01); *B65H 2701/1924* (2013.01); *B65H 2701/51* (2013.01)

(58) Field of Classification Search

CPC .... B65H 75/10; B65H 75/20; B65H 2701/51; B65H 18/28; A47K 10/16; A47K 2010/389

See application file for complete search history.

(56) References Cited

U.S. PATENT DOCUMENTS

| | | | | |
|---|---|---|---|---|
| 2,350,369 | A * | 6/1944 | Sampair | A61F 15/002 206/411 |
| 3,179,245 | A * | 4/1965 | Bastian, Jr. | B65H 75/08 156/185 |
| 3,451,639 | A * | 6/1969 | Rawson | B65H 75/18 138/140 |
| 6,089,483 | A * | 7/2000 | St-Laurent | B65H 75/182 116/1 |
| 2008/0135672 | A1* | 6/2008 | Fabian | B65H 75/10 242/571 |
| 2014/0001306 | A1* | 1/2014 | Noumi | B65H 75/10 242/613.2 |
| 2014/0231568 | A1* | 8/2014 | Mellin | B31C 1/00 242/160.1 |

FOREIGN PATENT DOCUMENTS

| | | | | |
|---|---|---|---|---|
| DE | 19910862 | A1 * | 9/2000 | B65H 75/14 |

* cited by examiner

*Primary Examiner* — William E Dondero
(74) *Attorney, Agent, or Firm* — Gary P. Topolosky

(57) ABSTRACT

A roll of absorbent paper product having a central tube about which absorbent paper product, paper towels or toilet tissue, is wound. The central tube consists of one or more rows of pre-curved, compacted sponges for use when the absorbent paper product has been completely unwound therefrom. The individual sponge units can be pre-infused with one or more cleaners, waxes, etc. A method for making such central tube sponges is also disclosed.

19 Claims, 4 Drawing Sheets

PAPER PRODUCT CENTER SPONGE TUBE AND METHOD

CROSS REFERENCE TO RELATED APPLICATION

This is a perfection of U.S. Provisional Application No. 62/271,596, filed on Dec. 28, 2015, the disclosure of which is fully incorporated by reference herein.

BACKGROUND OF THE INVENTION

1. Field of the Invention

This invention relates to improved paper product center rolls. More particularly, it relates to paper towel rolls and toilet tissue rolls about which layers of paper product are wound or wrapped.

2. Description of the Prior Art

It is known to provide paper towel rolls wrapped around a center tube of cardboard. The innermost towels are "started" on that center roll using glue, soap or another non-destructive adhesive. Then layers of single or multi-ply papers (usually separated into individual sheets by pre-established perforations) are wound thereabout. For toilet tissue rolls, the same effect is accomplished though on a much smaller diameter/scale.

A typical, prior art center roll is shown in various views in accompanying FIGS. 1 through 6. Therein, the roll of paper product (paper towels or toilet tissues) is wound around a central cardboard tube that is supplied in a standard American length of 11 inches and standard American diameter of 1¾ inches for fitting on (or between) most paper towel holders. The standard American size of toilet paper roll runs about 4 inches wide with the same size diameter opening, or about 1¾ inches across.

For most applications, it is well known to make paper center rolls from a single section of cardboard cut in an elongated strip with diamond-like ends pointed in opposite directions. See especially, FIG. 6.

Recently, Kimberly-Clark introduced an environmentally conscious Scott Toilet Paper roll that has NO center tube. Instead, its sheets of toilet paper are wrapped around a stiffened, set of wavy centermost sheets as part of its new line of Naturals products.

There are numerous designs/variations pertaining to paper towel rolls and the means for wrapping papers about a central tube. Representative improvements include those shown in U.S. Pat. Nos. 5,451,013, 5,938,141 and Design Patent No. D205,497. More recently, the center tube was replaced with a liquid dispenser in U.S. Pat. No. 5,671,872. And while there were tangential, passing references to sponges in a paper roll/cleaning context in U.S. Pat. Nos. 4,516,676, 5,467,936 and 7,392,921, none of these teach or suggest anything even remotely resembling the present invention.

SUMMARY OF THE INVENTION

This invention is designed to replace the center or central tube of a paper towel roll and/or toilet paper roll using a plurality of flattened (or compacted, dried out) sponge alternatives to the cardboard used to make up the center rolls of most existing product lines. Preferred embodiments use recycled artificial sponge materials that can be shaped (slightly curved) and connected to one another until snapped apart into separate sponges and/or exposed to moisture. In this manner, once a roll has been emptied of its wrap around absorbent paper product, it can be FULLY used to separate apart into a plurality of distinct absorbent sponges. Some of these sponges may be pre-infused with cleaners. Still others may include an abrasive side or edge.

A preferred method of this invention exploits such center sponges by allowing for advertising and/or product redemption (i.e., coupons, etc.) for placement thereon. Proposed methods of manufacture include providing a plurality of sponge sheets or sponge-material, drying them about a mandrel to form a curved central tube (or column) and feeding the columns made from such drying into a towel wrapping machine. There is also disclosed a method for promoting paper towel marketing that includes advertising redemption coupons and/or discount offers on such central sponges.

BRIEF SUMMARY OF THE DRAWINGS

Further features, objectives and advantages of this invention will be clearer when reviewing the following Detailed Description made with reference to the accompanying drawings in which.

DETAILED DESCRIPTION OF PREFERRED EMBODIMENTS

Figure 1:
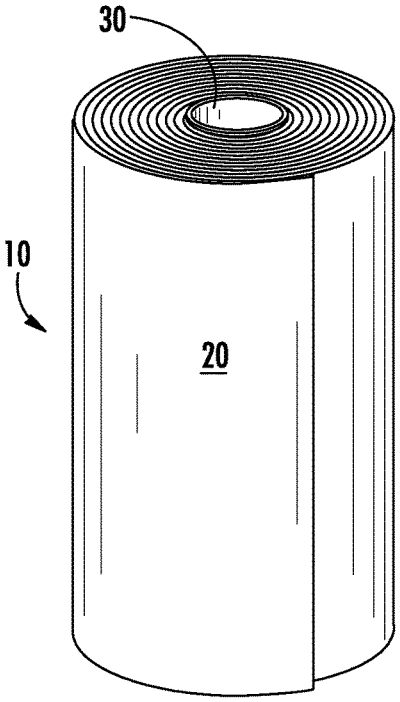
FIG. 1 (PRIOR ART)
FIG. 1 is a front perspective view of a prior art roll of paper towels on one of its two wound ends (or bases) with the central tube situated in the middle of same.
Figure 2:
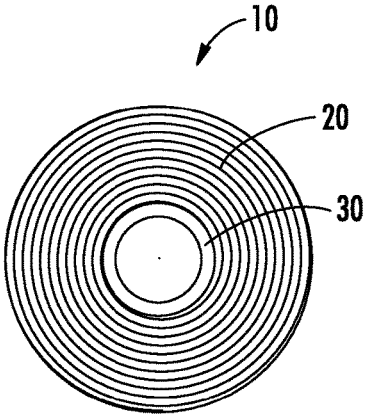
FIG. 2 (PRIOR ART)
FIG. 2 is a top plan view of the prior art roll from FIG. 1.
Figure 3:
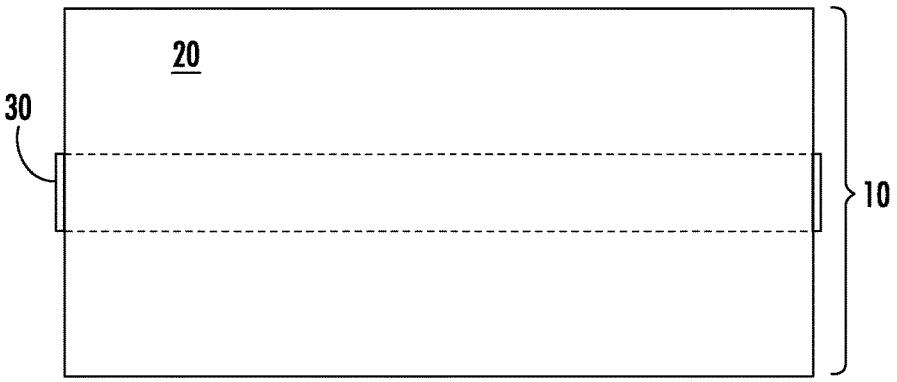
FIG. 3 (PRIOR ART)
FIG. 3 is a side view of the prior art roll from FIGS. 1 and 2 showing the central tube in its middle with dashed lines.
Figure 4:
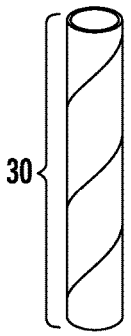
FIG. 4 (PRIOR ART)
FIG. 4 is a front perspective view focusing on the central tube from the prior art roll of FIGS. 1 through 3.
Figure 5:
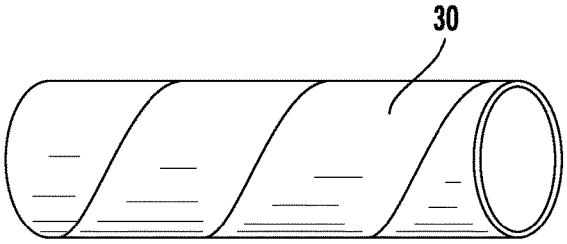
FIG. 5 (PRIOR ART)
FIG. 5 is a side perspective view of the central tube from FIG. 4 lying lengthwise.

It is a primary object of this invention to reduce/eliminate the waste of cardboard center tubes used for the wrapping of paper towels and/or toilet paper by making usable materials, especially curvy sponges, about which the paper products can be wrapped. It is another object to provide advertising/promotional markings on such sponges for further product purchase proliferation.

It is another object to provide these sponges with a variety of alternative uses . . . particularly a roll of towels may be provided with a row of sponges that are "pre-soaped"; another with a roll or sponges that are "pre-bleached" and a third row having sponges with one or more edges/faces that have an abrasive (scrubbing) component.

It is another object to provide these sponges with one or more licensed cartoon characters for promoting the efforts of young children to help with daily clean up chores. Yet another variation could include word and/or number games-clues on such central sponges.

The existing prior art of absorbent paper product wrapping has evolved to the typical center/central tube or rolls shown in accompanying FIGS. 1 through 6. Particularly, that prior art roll 10 of paper product, in this case, absorbent paper towels 20, is wound about a central tube 30 of cardboard curved to create a column. As better seen in FIGS. 4 through 6, that central tube 30 may be made from one single section 32 of cardboard having a top edge 34, a bottom edge 36 and terminating in slanted side edges 38 so as to form an elongated parallelogram (per FIG. 6).

Apart from children's crafts, the "emptied" tube from a paper towel or toilet paper roll serves little functional purpose. It will also, most likely, end up in a landfill serving as an environmental waste rather than continuing on with a functional "afterlife". This invention satisfies both objectives of making a useful central tube product while further assisting with environmental waste reduction.

Figure 7:
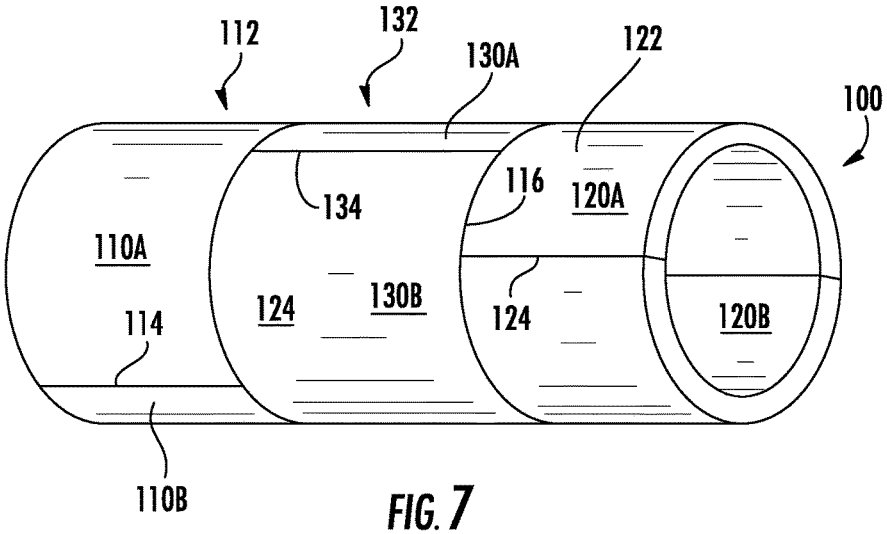
FIG. 7 is a side perspective view of a first embodiment of this invention showing a paper towel tube comprised of three rows of sponge pairs (two sponges per row)

A first embodiment of central tube according to this invention is seen in the three sectioned variation depicted in accompanying FIG. 7. That central tube 100 consists of a first compacted (and dried out) sponge pair 110A and B which are arranged as their own row 112 by curving about and reconnecting along their adjoining short ends 114. A second pre-curved sponge pair 120A and B is situated as another row 122 at the opposite end of tube 100 with its own set of adjoining end connections 124. Between these two tube rows 112 and 122 is an intermediate (or third) row 132, made from curved sponges 130A and B joined together along common short ends 134. The first and third rows sandwich the middle row of pre-curved sponges by joining (albeit, temporarily, i.e., only during their use as a central tube roll—but are separable thereafter into individual sponge units once all the paper product has been removed from this central tube) along long ends 116. While this first embodiment is shown as comprising three rows of sponge pairs for a paper towel central tube, it is to be understood that the number of sponges in a row and the number of rows may vary depending on the relative sizes of individual sponge units AND based on their intended use (as either a paper towel central tube OR toilet tissue central tube).

Figure 8:
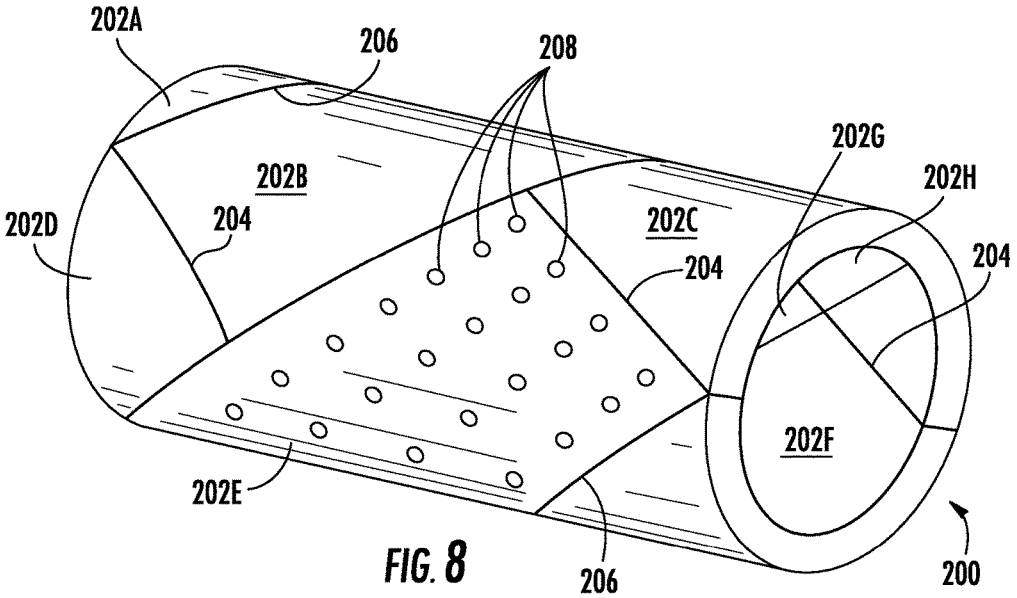
FIG. 8 is a side perspective view of a second embodiment of paper towel tube showing a six sponge arrangement in a columnar wrapped alternative.

A second embodiment of central tube 200 is shown in FIG. 8. Therein, multiple sections of pre-curved sponge units 202A through 202H are arranged and stuck together in a spiral pattern more like that of the single cardboard, prior art central tube shown at FIG. 5. The respective sponge units of this second tube are joined along adjacent short ends 204 as well as along adjoining long sides 206.

As for the customized sponges to be included in any given set of paper towel rolls, representative rolls include the pre-soaped, pre-bleached or otherwise infused, via apertures 208 in the one sponge unit 202E of FIG. 8, with a small quantity of car wax, window cleaner, tire (and/or chrome) cleaner or vinyl/leather cleaner.

Figure 9:
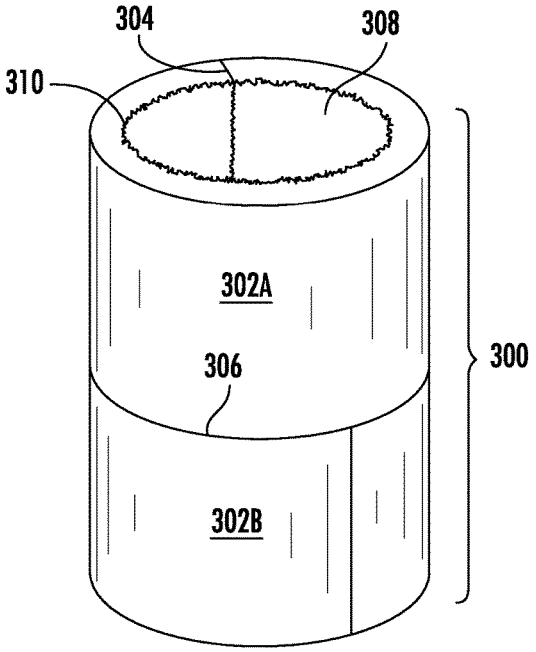
FIG. 9 is a front perspective view of a first embodiment of toilet paper center roll made from two rows of sponges, one sponge per row.

FIG. 9 depicts a third variation of central tube 300, this time a "roll" sized to serve primarily as a wrap around for toilet tissue (or as a toilet paper roll, once fully completed). In this alternately sized, shorter tube variation, there are only two rows 302A and B of pre-curved sponge units with each row comprised of a single section of sponge joined to itself along short ends 304, then temporarily adhered between upper and lower sponge rows along their respective, adjoining long ends 306.

FIG. 9 also shows an optional variation of this invention in which one or more sides of an individual sponge unit can be provided with an abrasive, scrubbing surface. In FIG. 9, upper sponge row 302A includes such a surface 308. Alternatively, or in combination with a whole scrub face to a sponge, one or more units may be provided with a scrubbing edge 310.

Figure 10:
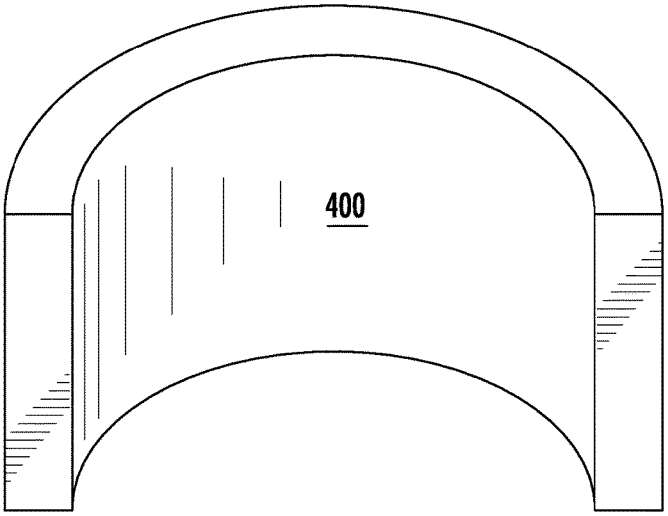
FIG. 10 is a front perspective view showing a representative sponge component for use in assembling into a paper roll according to this invention.

In the fourth variation shown at FIG. 10, there is depicted a single sponge unit 400 that has been cut (or machined) from a larger section of sponge material (not shown) into a semi-circular shape. Dimensionally, this half-tube or half-roll could be made into a toilet tissue tube OR into a paper towel central tube when combined with a second half-tube, also made by cutting/machining into this half-curved shape.

There are numerous methods of individual tube manufacture that this invention may address—still others may be subsequently developed. One particular process includes cutting sections of curvy sponges into typical horizontal rows with one or two sponges per row. The rolls can be assembled with two or more such rows (two for a toilet paper roll and three or more for a paper towel roll) before being fed into a machine for wrapping paper product thereabout.

Figure 6:
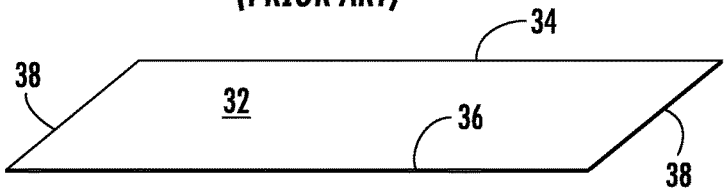
FIG. 6 (PRIOR ART)
FIG. 6 is a top plan view of the central tube from FIGS. 4 and 5 opened up to show its general dimensions before being wound about itself to form the typical prior art cardboard tube.

Alternately, sponge material can be formed into elongate rolls resembling the cardboard feedstock of FIG. 6 before being wrapped about a mandrel and glued in place to form a central paper roll for paper towels and/or toilet paper. This elongate variation can be pre-perforated so as to be easily severable into sub-sections of sponge units after all paper product wrapped there around has been removed therefrom.

Yet another alternative (not shown) could comprise forming elongate tubes of curvy sponges before feeding such tubes into a spaced perforator (that will make it easier to separate—almost by simply tearing apart row A from row B and/or sponge 1 from sponge 2 in any given row.

Yet another alternative could include taking sections of round sponges (natural OR artificial) and machining them to a standard outer circumference and drilling a standard sized inner bore there through before wrapping a paper product (paper towels/toilet paper) around the "core" sponge tube.

While primarily shown for paper towels and secondarily for toilet paper, it is understood that still other paper products on a roll could also benefit from this central sponge concept. That includes (but is not limited to) napkins, baby wipes and/or industrial towels/wipes.

Figure 11:
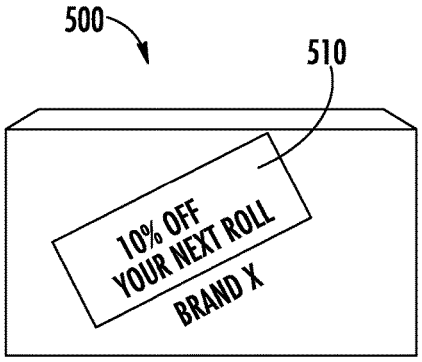
FIG. 11 is a front perspective view showing one embodiment of promotional advertising (with a redeemable coupon) displayed on a side face thereof.
Figure 12:
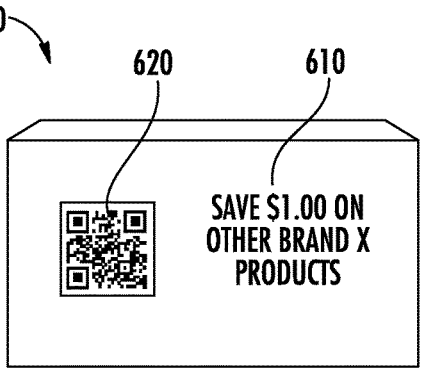
FIG. 12 is a front perspective view showing a second embodiment of promotional advertising (using a QR code) on a side face of a sponge for the center roll of a paper towel or toilet paper roll.

The addition of advertising markings can also run the gamut of endorsements/cross-product appeals with discounted dollar amounts/percentages reduced and/or other promotional tie-ins. FIG. 11 shows an individual sponge 500 that has a redemption coupon 510 pre-printed thereon; and the sponge 600 at FIG. 12 has its own coupon 620 supplemented with an informational QR reader code 620. Any such coupon addition should NOT be time sensitive as it may take time for a newly purchased roll of sponge paper towel wraps to work its way to "empty" thereby exposing the promotional coupons at the roll's inner core.

What is claimed is:

1. A roll of absorbent paper product having a central tube about which the absorbent paper product is wound, said central tube consisting of one or more rows of pre-curved, compacted sponges for use when the absorbent paper product has been completely unwound therefrom.

2. The paper product roll of claim 1 wherein the central tube consists of two or more pre-curved compacted sponges arranged in a vertical column.

3. The paper product roll of claim 1 wherein the central tube consists of two or more pre-curved compacted sponges arranged in a spiral.

4. The paper product roll of claim 1 wherein the central tube consists of two or more pre-curved compacted sponges arranged diagonally.

5. The paper product roll of claim 1 wherein the paper product is a paper towel.

6. The paper product roll of claim 1 wherein the paper product is a toilet tissue.

7. The paper product roll of claim 1 wherein at least one sponge includes a promotional coupon.

8. The paper product roll of claim 1 wherein at least one sponge includes a QR reader code.

9. The paper product roll of claim 1 wherein at least one sponge is pre-soaped.

10. The paper product roll of claim 1 wherein at least one sponge is pre-bleached.

11. The paper product roll of claim 1 wherein at least one sponge is pre-waxed.

12. The paper product roll of claim 1 wherein at least one sponge has an abrasive face or edge.

13. The paper product roll of claim 1 wherein at least one sponge has been infused with a window cleaner.

14. The paper product roll of claim 1 wherein at least one sponge has been infused with a tire cleaner.

15. The paper product roll of claim 1 wherein at least one sponge has been infused with a vinyl or leather cleaner.

16. A method for making a roll of absorbent paper product comprises:

(a) providing a sheet of sponge material and drying the sheet about a mandrel to make a curved central tube;

(b) providing a roll of substantially continuous absorbent paper product; and (c) winding the continuous absorbent paper product about the curved central tube of sponge material.

17. The method of claim 16 wherein the sheet of sponge material includes a plurality of perforations for easily tearing into multiple sponges.

18. The method of claim 16 wherein the absorbent paper product is selected from the group consisting of paper towel and toilet tissue.

19. The method of claim 16 wherein the central tube consists of multiple pre-curved, compacted sponges for use when the absorbent paper product has been completely unwound therefrom.

* * * * *